US008291523B2

(12) United States Patent
Virica

(10) Patent No.: US 8,291,523 B2
(45) Date of Patent: Oct. 23, 2012

(54) LIQUID DISPENSING DEVICE

(75) Inventor: Peter Virica, East Bolton (GB)

(73) Assignee: Jeyes Group Limited, Thetford (GB)

( * ) Notice: Subject to any disclaimer, the term of this patent is extended or adjusted under 35 U.S.C. 154(b) by 1003 days.

(21) Appl. No.: 12/282,864

(22) PCT Filed: Mar. 13, 2007

(86) PCT No.: PCT/GB2007/000885

§ 371 (c)(1),
(2), (4) Date: Nov. 24, 2008

(87) PCT Pub. No.: WO2007/104977

PCT Pub. Date: Sep. 20, 2007

(65) Prior Publication Data

US 2009/0077727 A1 Mar. 26, 2009

(30) Foreign Application Priority Data

Mar. 13, 2006 (GB) ..... 0605023.1

(51) Int. Cl.
*E03D 9/03* (2006.01)

(52) U.S. Cl. ..... 4/227.7; 4/227.1; 4/222

(58) Field of Classification Search ..... 4/222, 227.1, 4/227.7

See application file for complete search history.

(56) References Cited

U.S. PATENT DOCUMENTS

| | | | | |
|---|---|---|---|---|
| 6,412,120 | B1 * | 7/2002 | Leonard et al. | 4/223 |
| 7,114,199 | B2 * | 10/2006 | Conway et al. | 4/231 |
| 2002/0178493 | A1 | 12/2002 | Varanasi et al. | |
| 2003/0156976 | A1 * | 8/2003 | Wilson et al. | 422/28 |
| 2004/0031091 | A1 | 2/2004 | Landesberg et al. | |
| 2004/0088781 | A1 | 5/2004 | Suffa | |
| 2005/0028256 | A1 | 2/2005 | Pagani | |

FOREIGN PATENT DOCUMENTS

| | | | |
|---|---|---|---|
| EP | 0 538 957 | A1 | 4/1993 |
| WO | WO 00/42261 | A1 | 7/2000 |
| WO | WO 01/32995 | | 5/2001 |
| WO | WO 01/32995 | A1 | 5/2001 |
| WO | WO 02/36895 | A1 | 5/2002 |
| WO | WO 02/40787 | A1 | 5/2002 |
| WO | WO 02/40791 | A1 | 5/2002 |
| WO | WO 02/40792 | A1 | 5/2002 |
| WO | WO 02/064898 | A1 | 8/2002 |
| WO | WO 2004/072390 | | 8/2004 |
| WO | WO 2004/092493 | A1 | 10/2004 |

* cited by examiner

*Primary Examiner* — Gregory Huson
*Assistant Examiner* — Karen L Younkins
(74) *Attorney, Agent, or Firm* — Dickstein Shapiro LLP

(57) ABSTRACT

In a liquid delivery device for a toilet, a container (3) for the liquid has an outlet (15) which extends into a cup (35). The cup (35) is open to the atmosphere and liquid flows into the cup (35) until the mouth (25) of the outlet is covered by liquid in the cup. The cup wall has a weir (45) and liquid in the cup (35) overflows the weir (45). A collar (61) around the outside of the cup (35) forms a capillary with the cup wall to control the flow of liquid and feed it to capillary channels on a delivery plate (9) below the level of the weir.

17 Claims, 5 Drawing Sheets

LIQUID DISPENSING DEVICE

The present invention relates to a device for dispensing a liquid into a toilet bowl. Typically the liquid includes one or more active substances such as a surfactant, a colorant or a bleach. In Europe and the USA such devices are often clipped over the side of the toilet bowl so that flush water will rinse the liquid from a delivery surface into the toilet bowl. In countries such as Japan, the device may also be carried on top of the toilet cistern, for example, where water from a spout runs over the delivery plate before filling the cistern. Examples of such devices can be seen in EP-A-538957, WO 00/42261, WO 01/32995 and WO 02/36895. Devices delivering two liquids or a combination of a liquid and solid are also known and described, for example, in WO 02/064898, WO 02/40791, WO 02/40792 and WO 02/40787.

As will be appreciated from a study of the documents mentioned above that, there has been considerable effort to develop a device which ensures an even dosage of liquid into the toilet bowl over time. For example, it has been found that with some arrangements the liquid in the liquid reservoir becomes diluted by the flush water, reducing the viscosity of the liquid until it flows too rapidly from the reservoir, giving the user an impression of a sudden loss of liquid.

In WO 00/42261 we disclose a system in which the outflow of liquid from the reservoir, which is an upturned bottle, is controlled by two closely spaced plates with capillary channels feeding the liquid onto a delivery plate which is exposed to the flush water. In WO 01/32995 we use a construction providing a constant head of liquid in a reservoir below the container outlet and a capillary for ducting the liquid onto the delivery surface.

In one aspect, the present invention provides a liquid delivery device comprising:

- a container for the liquid, the container having an outlet which, in use, is below the upper level of liquid in the container;
- a cup having a wall surrounding a mouth of the container outlet, the cup being open to the atmosphere whereby, in use, liquid flows into the cup until the mouth is covered by liquid in the cup,
- the cup wall having a weir formed therein whereby, in use, liquid in the cup overflows the weir;
- a delivery surface below the level of the weir, and a capillary fluidly connecting the weir with the delivery surface.

In use, liquid from the container fills the cup to a level just above the mouth of the container outlet and overflows the weir in the container wall to be ducted by the capillary onto the delivery surface. Flush water washes the liquid off the delivery surface.

The flow of liquid is regulated by the capillary, the level of liquid in the cup rising to cover the mouth of container outlet when flow through the capillary is slower than the rate of filling the cup. As the cup is emptied by the flow through the capillary, the mouth of the container outlet is uncovered and so air can enter the container to allow more liquid to flow into the cup until the mouth is covered again.

With many prior art devices, the rate of liquid flow onto the delivery surface varies with the orientation of the device. With a plate-like delivery surface, typically the device is designed on the assumption that the delivery plate is horizontal in use. If the device is mounted so that delivery plate slopes downward, away from the container, liquid flow increases. If the delivery plate slopes upward away from the container, the liquid flow decreases.

We have found that by appropriate positioning of the weir in the cup wall, we can provide for a flow rate which is largely independent of the orientation of the device in normal use. In particular, the weir is preferably provided on a side of the cup opposite to the delivery surface. Preferably the weir is in a position diametrically opposite to the delivery surface, which extends away from the cup.

With a plate-like delivery surface, when the delivery plate slopes downwards away from the cup, the weir is in a higher position, relative to the mouth of the container outlet, and so the height or flow of liquid over the weir is reduced. Conversely, if the delivery plate slope upwards, the weir is in a lower position relative to the mouth of the container outlet and so there is a higher level of liquid above the weir, to increase the liquid flow into the capillary and so assist the flow of liquid onto the upwardly sloping delivery plate.

Preferably the cup is integrally formed on an upper surface of the delivery surface. Channels may be provided on a plate-like delivery surface to duct liquid away from the cup. The channels may extend out onto surface of the delivery plate which is exposed to the flush water.

Preferably the weir is formed by cut out or slot in the cup wall.

Preferably a capillary is formed, to duct liquid from the weir to the delivery surface, by providing a close fitting collar around the outer surface of the cup wall, the capillary being formed between the collar and cup wall outer surface. The cup wall outer surface and/or the facing surface of the collar may be shaped to form a capillary channel or channels extending away from the weir. Preferably the channels duct liquid around the cup outer surface to adjoining channels in the delivery plate. Preferably the collar is integrally formed with a holder which supports the container.

A strap maybe provided for attaching the device to a rim of a toilet bowl.

A plurality of containers or a container having a plurality of compartments may be provided, with a respective cup for each container or compartment.

The invention will be further described by way of example with reference to the accompanying drawings, in which.

Figure 1:
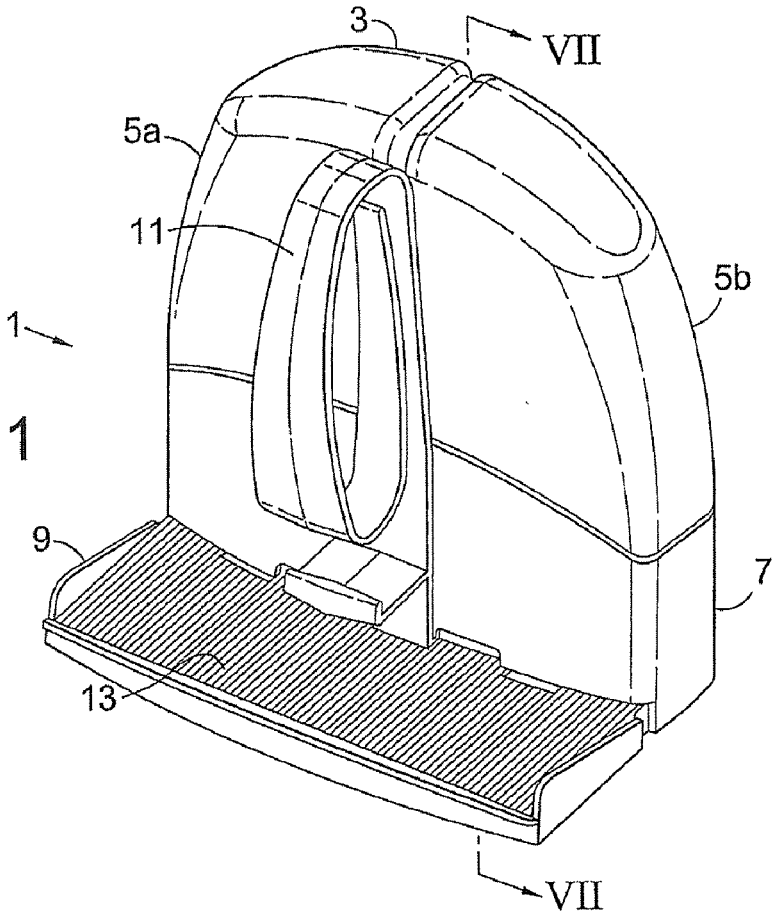
FIG. 1 is a perspective view of a liquid delivery device forming an embodiment of the invention.

FIG. 1 shows a liquid dispensing device 1 which is particularly suited for attachment to the rim of a toilet bowl. The device 1 comprises a container 3 which has two compartments 5*a*, 5*b* each containing a respective liquid. Container 3 is supported in a holder 7 to which is clipped a delivery plate 9 forming a delivery surface. Container 3 includes a flexible strap 11 which is unwound to clip the device onto the rim of the toilet bowl, with the exposed portion 13 of the delivery plate 9 extending under the rim, into the path of the flush water as is well known in the art.

For silent flow toilets, such as are common in the USA and in which the flush water flows over the toilet bowl surface, the plate 9 extends to touch the bowl surface or it may be provided with a hinged lip at its free end to touch the bowl surface, as is known in the art.

Figure 2:
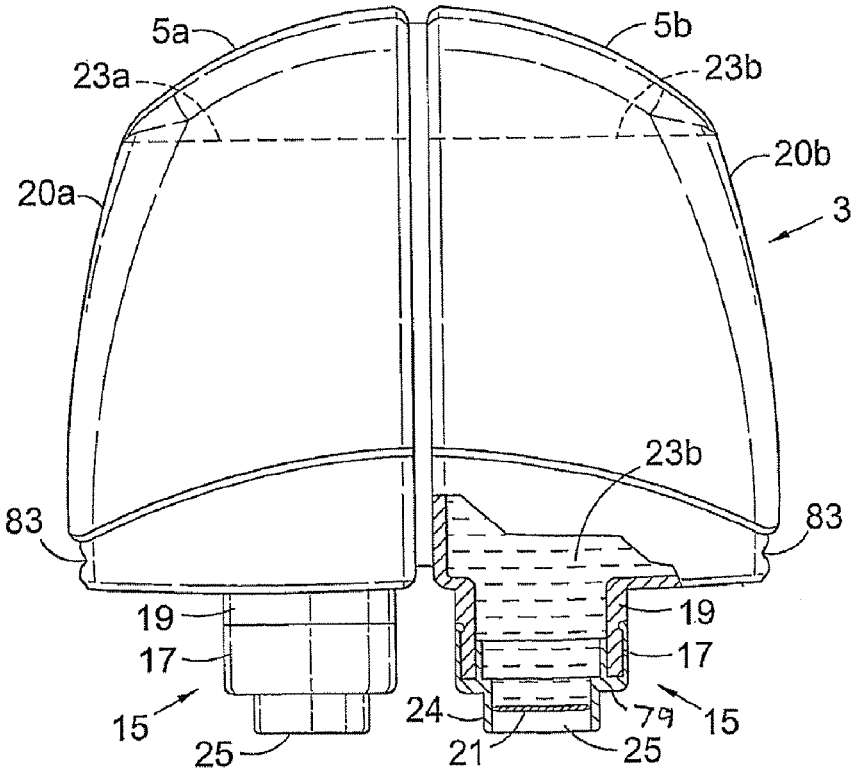
FIG. 2 is a front view of a container of the embodiment of FIG. 1, having two compartments.

Referring to FIG. 2, the container 3 has two compartments 5*a*, 5*b* which may contain the same liquid formulation, but preferably different formulations are used.

Suitable formulations are well known in the art and are typically water based, containing one or more active ingredients such as a colorant, a surfactant and/or bleach. By having two compartments, ingredients which are not compatible when mixed for long periods, such as some bleaches and colorants, may be used in the respective formulations.

Container 3 may be formed with a single compartment, and a single outlet if preferred.

Each compartment 5*a*, 5*b* has an outlet 15 formed by a cap 17 mounted on a neck 19 which is integral with the compartment body 20*a*, 20*b*. Cap 17 includes a frangible seal 21 which is displaced by a pin (vide hereinafter) to open the outlet to release the respective liquid 23*a*, 23*b*.

Cap 17 is mounted on the neck 19 to close the respective container compartment 5*a*, 5*b*, after it is filled. Cap 17 includes a downwardly depending sleeve 24 which defines a mouth 25 of the outlet 15.

Figure 3:
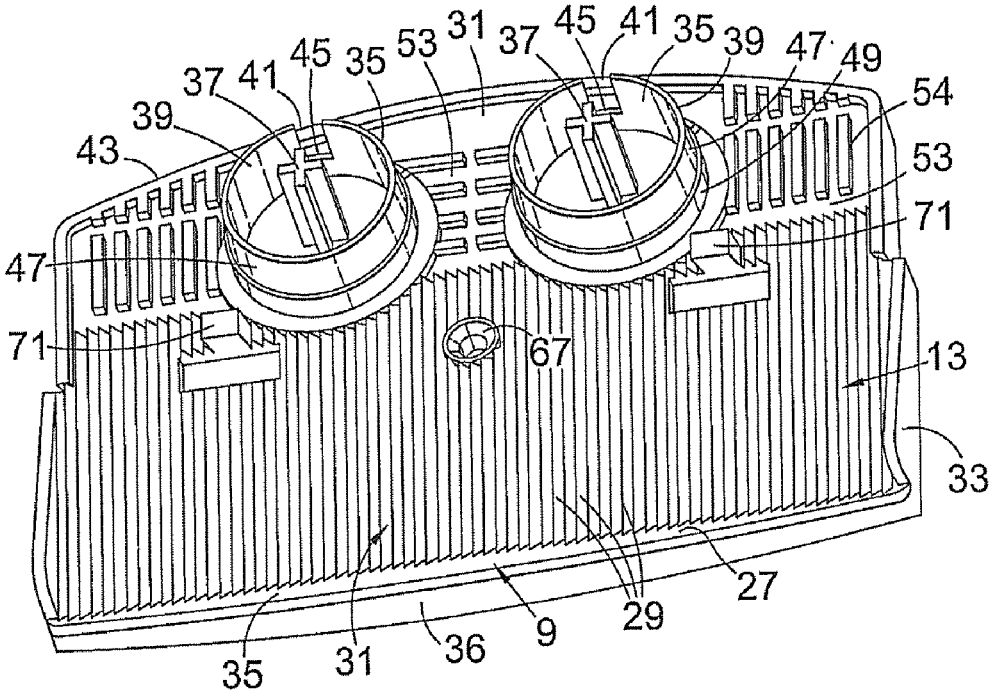
FIG. 3 is a perspective view of a delivery plate and cups of the embodiment of FIG. 1.

Referring to FIG. 3, the delivery plate 9 has a planar base 27 which has a multitude of capillary like narrow cross-section channels 29 formed on its upper surface 31 in a region 13 which is exposed, in use, to the flush water (cf FIG. 1). Sidewalls 33 are formed at the edges of the base 27 in the exposed portion 13 and the base also has an upward lip 35 at its front edge 36 to inhibit dripping from the delivery plate 9.

Figure 4:
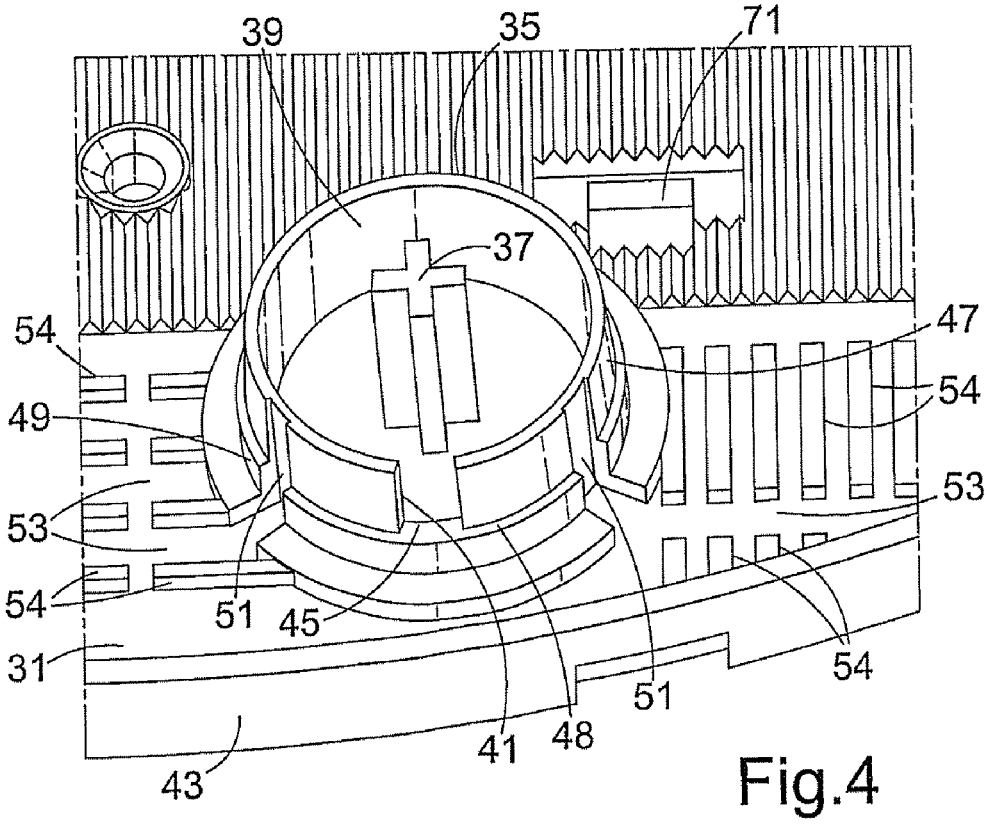
FIG. 4 is an enlarged perspective view of a cup of the delivery plate of FIG. 3.

At the other, inner end of the delivery plate 9, two cups 35 are integrally moulded on the base 27. Centrally within each cup 35 is a pin 37 extending up from the base 27 and which, in use, displaces the frangible seal 21 to open the respective container compartment 5*a*, 5*b*. Cup 35 has a circular wall 39 which has a cut out or slot 41 extending down from the upper edge of the cup; and adjacent the rear edge 43 of the delivery plate 9. The bottom edge of the slot 41 forms a weir 45. The outer surface 47 of the cup wall 39 has a step 48, the wall 39 being thicker at its lower end 49 adjacent the base. The wall 39 forms part of a capillary channel as will be described hereinafter with reference to FIG. 7. Referring to FIG. 4, step 48 extends almost fully around the outer surface 47. Channels 51 are formed in the outer surface 47 and extend down through the thicker portion 49 to provide a passage for liquid to flow down to distribution channels 53 formed in the upper surface 31 of the delivery plate 9. In use, liquid 23*a*, 23*b* flows into the channels 53 to spread laterally outwards from the cups 35. Channels 53 are defined by ribs 54 formed on the surface 31.

Figure 5:
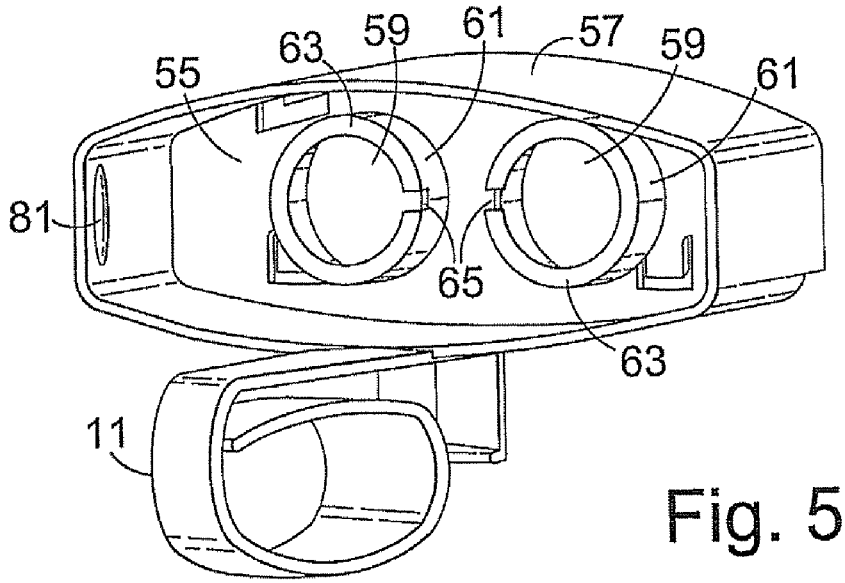
FIG. 5 is a perspective view from above a holder of the embodiment of FIG. 1.
Figure 6:
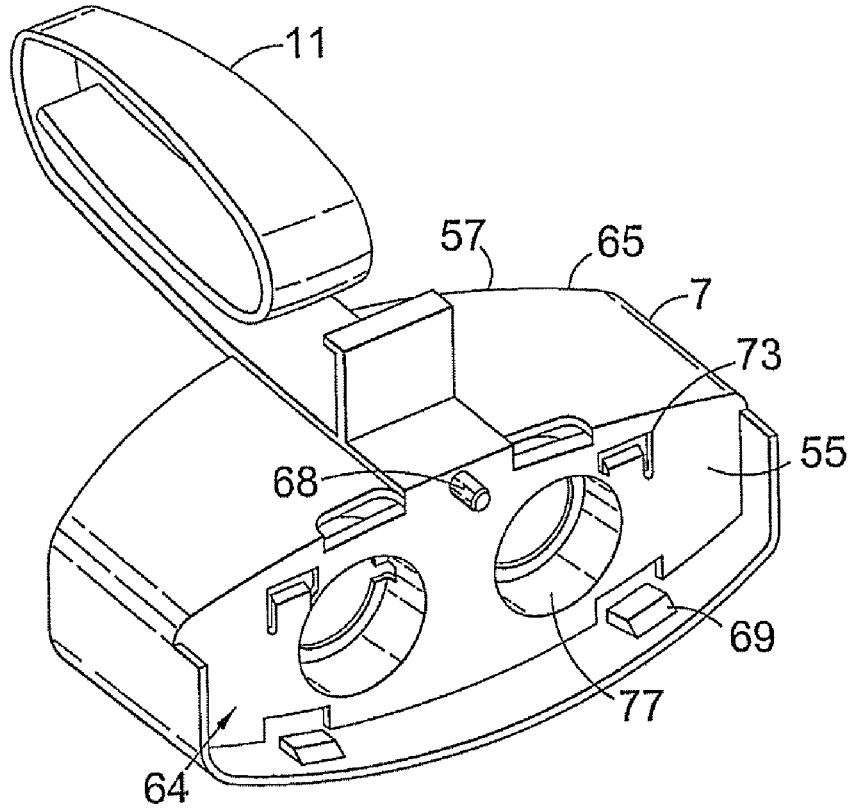
FIG. 6 is an underneath perspective view of the holder of FIG. 5.

Referring to FIGS. 5 and 6, the holder 7 has a base 55 with a peripheral wall 57 which extends upwards from the base to help support container 3. Wall 57 extends below the base 55 on three sides, as seen in FIG. 6, to mate against the rear edge 43 of delivery plate 9. Base 55 has two apertures 59 which are bound by collars 61 extending up from the base 55 and ending in an inwardly extending rim 63. A vent slot 65 is formed in each collar 61.

Delivery plate 9 is a snap fit onto the underside 64 of the base 55 of holder 7. A locating pin 68 extends through an aperture 67 in delivery plate 9. The rear edge 43 of delivery plate 9 engages between nibs 69 and the base 55, and dogs 71 snap in to slots 73 to secure the delivery plate 9 in place. In this position, the underside 64 of the base 55 rests on or closely above the ribs 54 defining capillary channels 53 and so forms a capillary channel or space between the underside 64 of the base 55 and the plate 9, in a manner similar to that seen in WO 00/42261.

Figure 7:
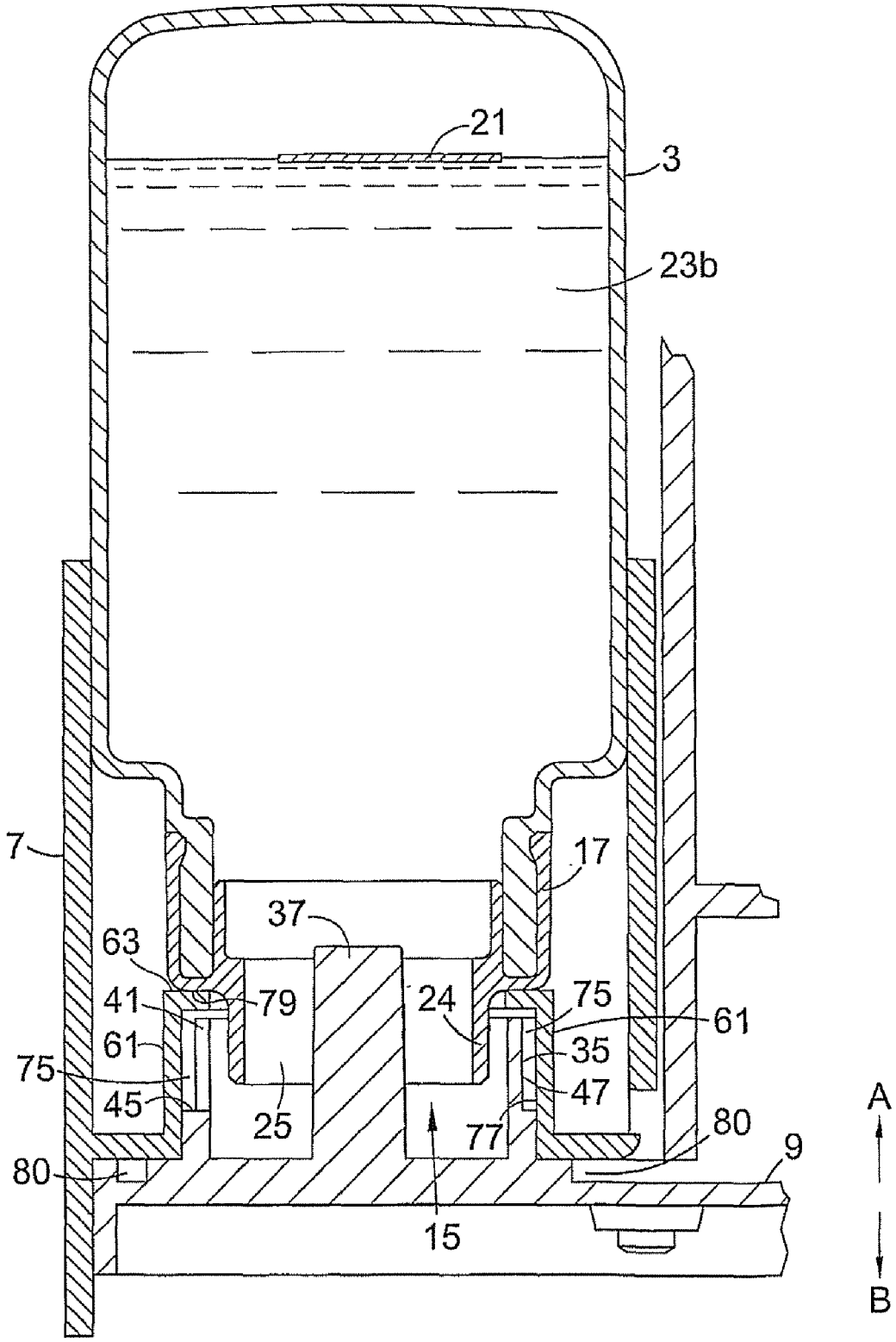
FIG. 7 is a cross-section along the line VII-VII of FIG. 1.

The cups 35 are snugly received in the respective collars 61. As seen in FIG. 7, a capillary channel 75 is formed between the outer wall 47 of a cup 35 and the facing surface 77 of the collar 61.

In use, the device is supplied to the consumer with the delivery plate 9 and holder 7 assembled together and the container 3 separate, with the frangible seal(s) 21 in place. To use the device, the consumer inverts the container and presses it into the holder 7, the sleeves 24 of the cap 17 entering the cup 35 and the pin 37 breaking the frangible seal 21. The seal floats to the upper surface of the liquid in the container.

The shoulder 79 of cap 17 rests on the rim 63 of the collar 61 and the container 3 is held in place in the holder 7 by protrusions 81 in the holder wall 57 (see FIG. 5) which engage in recesses 83 in the container body 20. (FIG. 2).

Liquid 23 flows into the cup 35 until it closes or covers the mouth 25 of the container outlet 15. The liquid will rise slightly above the mouth 25 until the reduced pressure above the liquid in the container prevents further outflow. The vent 65 in the rim 63 ensures that the cup 35 is open to atmosphere. With the device horizontal as shown in FIG. 7, the liquid is just above weir 45 and so is ducted into the capillary channel 75 formed between the outer surface 47 of the cup 35 and the inner surface 77 of the collar 61 and flows down into the channels 53 in the capillary space 80 formed between the surface 64 of the holder base 55 and the delivery plate 9.

If the device is mounted at an angle, the vertical position of the weir 45 relative to the mouth 25 of the outlet 15 is altered. With the delivery plate sloping upward (arrow A in FIG. 7) the level of liquid over the weir 45 will increase as liquid will, in effect, flow to the back of the cup 35 and so there is a greater height of liquid above the weir 45, increasing the flow of liquid into the capillary channel 75. Conversely, if the delivery plate slopes downward (arrow B in FIG. 7) the liquid in the cup tends to flow away from the weir 45, reducing the height of liquid above the weir 45 and so reducing the liquid flow into the capillary 75.

Figure 8:
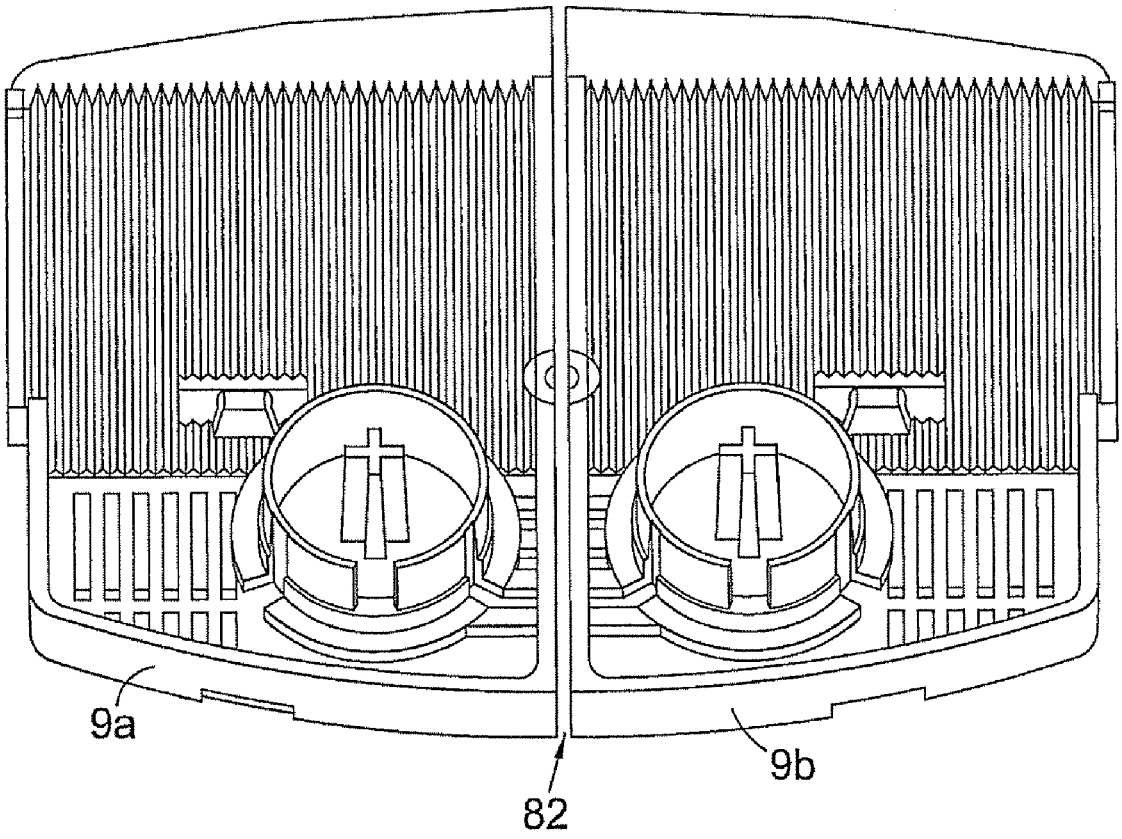
FIG. 8 shows a modification to the delivery plate of the embodiment of FIGS. 1 to 7.

Referring to FIG. 8, this shows two separate plates 9*a*, 9*b* which, taken together, correspond to the delivery plate 9 of FIG. 3. A space 82 is provided between the plates 9*a*, 9*b* when they are attached to the holder 7. Each plate half 9*a*, 9*b* will receive liquid from a respective container half 5*a*, 5*b* and so the liquids are kept separated until they are washed off the plates 9*a*, 9*b* by the flush water. To facilitate manufacture, the two plates 9*a*, 9*b* may be moulded as a single unit with a rib (not shown) bridging the space 82. As the plates are attached to the holder 7, the rib can be broken away to form a complete separation of the plates at the space 82.

The invention claimed is:

1. A liquid delivery device comprising:

a container for the liquid, the container having an outlet which, in use, is below the upper level of liquid in the container;

a cup having a wall surrounding a mouth of the container outlet, the cup being open to the atmosphere;

the cup wall having a weir formed therein below the mouth of the container outlet;

a delivery surface below the level of the weir, and a capillary fluidly connecting the weir with the delivery surface;

whereby, in use, liquid flows into the cup until the mouth is covered by liquid in the cup, liquid in the cup overflows the weir and is ducted by the capillary onto the delivery surface.

2. A device as claimed in claim 1, wherein the delivery surface extends away from one side of the cup in a first direction and the weir is provided in a position on the opposite side of the cup, opposite to the delivery surface.

3. A device as claimed in claim 1, wherein the delivery surface is a plate and the cup is integrally formed on an upper surface of the delivery plate.

4. A device as claimed in claim 1, comprising channels on the delivery surface to duct liquid away from the cup.

5. A device as claimed in claim 4, wherein the channels are provided on a part of the delivery surface which is exposed, in use, to flush water from a toilet on which the device is mounted.

6. A device as claimed in claim 1, wherein the weir is formed by a slot in the cup wall extending down from an upper edge of the cup wall.

7. A device as claimed in claim 6, comprising a close fitting collar around the outer surface of the cup wall, wherein the capillary is formed between the collar and cup wall outer surface.

8. A device as claimed in claim 7, wherein the collar is integrally formed with a holder which supports the container.

9. A device as claimed in claim 6, wherein the collar has a surface facing an outer surface of the wall of the cup, and wherein the facing surface is shaped to form a capillary channel or channels which directs the liquid away from the weir.

10. A device as claimed in claim 6, wherein an outer surface of the wall of the cup is shaped to form a channel or channels which directs the liquid away from the weir.

11. A device as claimed in claim 10, wherein the channel or channels duct liquid around the cup outer surface to adjoining channels provided in the delivery surface.

12. A device as claimed claim 1, comprising a strap for attaching the device to a rim of a toilet bowl.

13. A device as claimed in claim 1, comprising a plurality of containers, each container housing a respective liquid.

14. A device as claimed in claim 1, wherein the container has a plurality of compartments each having a respective outlet and containing a respective liquid.

15. A device as claimed in claim 13, comprising a respective cup for each container or compartment.

16. A device as claimed in claim 15, wherein a plurality of cups is provided on a single delivery plate.

17. A device as claimed in claim 15, wherein a plurality of delivery plates is provided, with a respective cup on a respective, separate, delivery plate.

* * * * *